US005334038A

United States Patent [19]

Davidge et al.

[11] Patent Number: 5,334,038

[45] Date of Patent: Aug. 2, 1994

[54] HIGH DENSITY CONNECTOR WITH SLIDING ACTUATOR

[75] Inventors: Ronald V. Davidge, Coral Springs; Todd A. McClurg; Jay H. Neer, both of Boca Raton; Richard J. Nelson, Boynton Beach, all of Fla.; Rocco J. Noschese, Wilton, Conn.

[73] Assignee: International Business Machines Corp., Armonk, N.Y.

[21] Appl. No.: 161,991

[22] Filed: Dec. 6, 1993

Related U.S. Application Data

[60] Continuation of Ser. No. 990,812, Dec. 14, 1992, abandoned, which is a division of Ser. No. 858,803, Mar. 27, 1992, abandoned.

[51] Int. Cl.[5] ..... H01R 13/62

[52] U.S. Cl. ..... 439/267; 439/260

[58] Field of Search ..... 439/59, 60, 260, 267, 439/325, 630, 633, 634, 308, 680, 681

[56] References Cited

U.S. PATENT DOCUMENTS

| | | | |
|---|---|---|---|
| 3,868,166 | 2/1975 | Ammon . | |
| 3,912,353 | 10/1975 | Kasuya et al. . | |
| 4,077,693 | 3/1978 | Briel, Jr. et al. . | |
| 4,080,027 | 3/1978 | Benasutti . | |
| 4,159,861 | 7/1979 | Anhalt | 439/267 |
| 4,257,665 | 3/1981 | John et al. . | |
| 4,376,565 | 3/1983 | Bird et al. . | |
| 4,479,686 | 10/1984 | Hoshino et al. . | |
| 4,480,884 | 11/1984 | Babuka et al. | 439/680 |
| 4,556,268 | 12/1985 | Noschese | 439/267 |
| 4,561,710 | 12/1985 | Bovermann . | |
| 4,648,668 | 3/1987 | Sinisi | 439/267 |
| 4,684,194 | 8/1987 | Jenkins et al. | 439/260 |
| 4,705,338 | 11/1987 | Sitzler | 439/260 |
| 4,715,820 | 12/1987 | Andrews, Jr. et al. | 439/59 |
| 4,734,042 | 3/1988 | Martens et al. | 439/62 |
| 4,743,203 | 5/1988 | Grabbe | 439/267 |
| 4,795,374 | 1/1989 | Rishworth et al. | 439/634 |
| 4,806,103 | 2/1989 | Kniese et al. | 439/60 |
| 4,824,383 | 4/1989 | Lemke | 439/108 |
| 4,846,734 | 7/1989 | Lytle | 439/637 |
| 4,884,975 | 12/1989 | Pelzl et al. | 439/78 |
| 4,885,482 | 12/1989 | Sharp et al. | 307/465 |
| 4,891,023 | 1/1990 | Lopata | 439/741 |
| 4,892,487 | 1/1990 | Dranchak et al. | 439/260 |
| 4,904,197 | 2/1990 | Cabourne | 439/260 |
| 4,932,885 | 6/1990 | Scholz | 439/260 |
| 4,934,961 | 6/1990 | Piorunneck et al. | 439/637 |
| 5,052,936 | 10/1991 | Biechler et al. | 439/60 |
| 5,096,435 | 3/1992 | Noschese et al. | 439/260 |

*Primary Examiner*—Larry I. Schwartz
*Assistant Examiner*—Hien D. Vu
*Attorney, Agent, or Firm*—Richard A. Tomlin; Ronald V. Davidge

[57] ABSTRACT

An electrical connector for removably receiving a daughter card includes a first group of contact springs, which extend in their free, undeflected state into a card-receiving slot, and a second group of contact springs, which are displaced from this slot in their undeflected state. This connector also includes an actuator, which can be moved to engage the second group of contact springs so that they are moved into the card-receiving slot. The actuator can be left in a position in which it is not so engaged when a first type of daughter card is inserted in the connector, with slotted portions of the daughter card passing over surfaces of the actuator. The actuator is moved into this engagement with the insertion of a second type of daughter card as surfaces on the daughter card push on surfaces of the actuator. The actuator also includes means by which it is locked to this second type of daughter card so that it is restored to its unengaged position as the daughter card is withdrawn from the connector. In an alternative embodiment, the engagement of the actuator is not controlled by the surfaces of the daughter card, but rather by manual movement of an engagement lever.

3 Claims, 3 Drawing Sheets

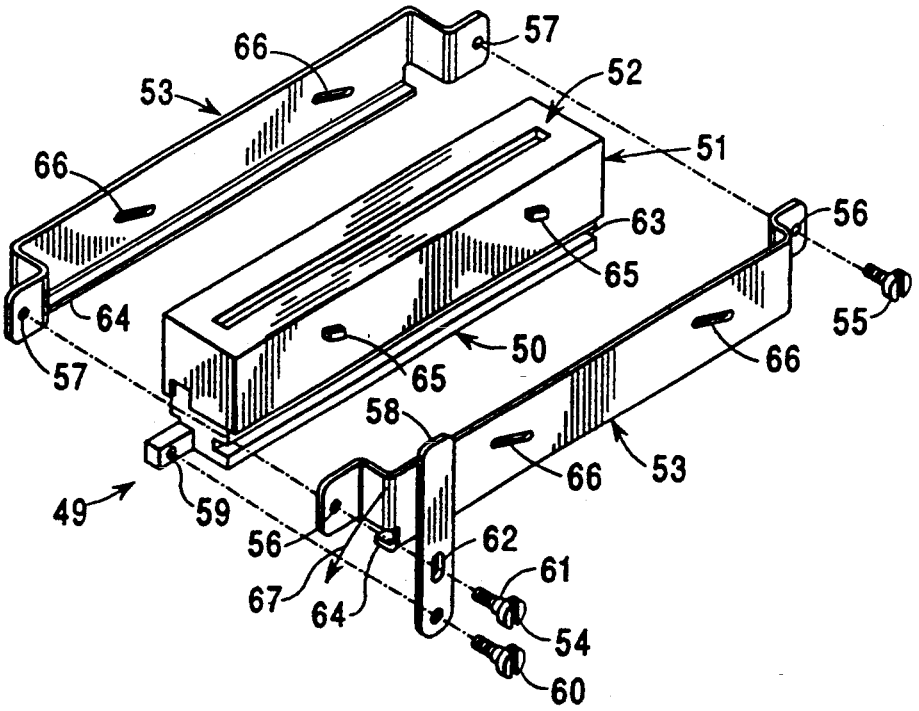
57
66
52
53
51
66
63
56
65
64
55
50
57
65
66
58
66
53
49
59
56
62
61
67
64
54
60

HIGH DENSITY CONNECTOR WITH SLIDING ACTUATOR

CROSS-REFERENCES TO RELATED APPLICATIONS

This application is a continuation of a prior application, Ser. No. 990,812, filed on Dec. 14, 1992, now abandoned, which is a division of a prior application, Ser. No. 858,803, filed Mar. 27, 1992, now abandoned.

A high-density interconnect system for solder attachment to a mother board and for removably receiving a daughter card of a first or second type is described in a co-pending U.S. application Ser. No. 858,803, filed Mar. 27, 1992. A daughter card of a first type has one row of conductive contact pads on each side of an insertion tab, adjacent to an insertion edge, while a daughter card of a second type, has two rows of conductive contact pads on each side of an insertion tab. The connector includes two rows of flexible contact springs on each side of a central card-receiving slot and solder tails extending into holes in the mother board, equally spaced in axial rows, with alternate rows being staggered in a manner providing optimal paths for circuit traces through the mother board among these holes. Essential circuits, needed for the proper functioning of various daughter cards which can be plugged into the connector, are connected through the daughter card contact pads in the rows adjacent to the insertion edge, and through the connector contact springs associated with these rows. Non-essential circuits, which provide additional features or enhanced performance, are connected though the other rows of conductive pads and contact springs.

BACKGROUND OF THE INVENTION

1. Field of the Invention

This invention relates to electrical connection systems, and, more particularly, to card edge connection systems wherein conductive pads arranged in rows adjacent to an edge of a daughter card are engaged by rows of contacts within a connector mounted on a mother board.

2. Description of the Background Art

In the construction of computers and other electronic devices, a need for modularity and design flexibility has made it necessary to build many devices using combinations of various circuits formed on individual printed circuit cards. Electrical connectors provide the means required for the removable assembly of such cards, including the circuit interconnections required among them. Industry trends, such as the miniaturization of electronic components and concurrent reductions in the cost of providing many functions through the use of electronic circuits, are greatly increasing the density of circuit lines on many printed circuit cards, placing similar increased density requirements on electronic connectors.

Many computers today use what is called a "mother board, a "system board," or a "backplane" board, which includes a number of circuits leading to electrical connectors, into which a number of "daughter boards" or "adapter cards" may be plugged to personalize a specific system and to provide particularly for connection to peripheral devices. In some computers, processor circuits on circuit cards are plugged into connectors in this way, as well.

For the sake of simplicity, in the following discussion the assumption is made that a "daughter card" is plugged into a connector attached to a "mother board" by soldering, that the mother board lies horizontally, and that the daughter card extends upward from the connector. It is understood that changes in orientation can easily be made without varying the concepts or hardware involve.

One type of connector which has proven especially effective in the construction of electronic devices is the card edge connector, which is typically configured to removably receive an edge of a printed circuit card in a central card-receiving slot. The card includes a single row of conductive pads on each side adjacent to the edge inserted in the connector. The connector includes a single row of flexible spring contacts on each side of the central slot, configured to be deflected outwardly by the insertion of the card and thereafter to make contact with the pads on the card. These contacts extend as solder tails outside a surface of the housing opposite to the central slot, to be fastened by soldering to individual circuits in the mother board. Thus, electrical connections are formed between circuits attached to the conductive pads on the card and circuits within the mother board. Examples of card edge connectors of this type are found in U.S. Pat. No. 3,868,166, which was issued to J. P. Ammon on Feb. 25, 1975, in U.S. Pat. No. 4,795,374, which was issued to P. L. Richworth et al. on Jan. 3, 1989, in U.S. Pat. No. 4,846,734, issued to Lytle on Jul. 11, 1989, and in U.S. Pat. No. 4,891,023, which was issued to J. E. Lopata on Jan. 2, 1990.

Furthermore, the use of multiple rows of contacts on each side of a card edge connector, providing contact surfaces along the central card-receiving slot at various distances from the entrance of this slot, together with a corresponding pattern of parallel rows of contact pads on each side of a daughter card, is practical and has been described, for example, in U.S. Pat. No. 4,806,103, which was issued to W. Kniese et al. on Feb. 21, 1989, and in U.S. Pat. No. 4,934,961, which was issued to H. Piorunneck et al. on Jun. 19, 1990.

Where there are different types of hardware that can be interconnected, with the possibility of causing malfunctions or damage if the wrong combinations are chosen, combinations of keys and keyways are often used to prevent misconnections. Typically these combinations are used simply to prevent the connection of certain devices and to assure that connected devices are properly oriented with respect to each other, as described, for example, in U.S. Pat. No. 4,257,665, which was issued to H. John et al. on Mar. 24, 1981, in U.S. Pat. No. 4,376,565, which was issued to P. S. Bird et al. on Mar. 15, 1983, in U.S. Pat. No. 4,715,820, which was issued to H. W. Andrews, Jr. et al. on Dec. 29, 1987, and in U.S. Pat. No. 4,884,975, which was issued to L. Peizl, et al. on Dec. 5, 1989. Key and keyway arrangements can also be used to determine how far a connector is inserted into a board in which it will be soldered, as described in U.S. Pat. No. 4,479,686, which was issued to M. Hoshino et al. on Oct. 30, 1984, or to determine how far a daughter card is inserted into a connector, as described in U.S. Pat. No. 4,934,961 to Piorunneck.

One particular concern with various types of changes to hardware is that of upgradability. In the marketplace, this concern is often expressed as a need to protect the investment of the customer. It is desirable that, when a customer purchases a new system, he should be able to use as much of his old hardware, which can represent a significant investment, as possible. On the other hand, if the desire for this kind of compatibility is allowed to dictate the way a new system is designed, progress often cannot be made toward increasing system function and performance. In the area of electrical connectors, increased function often means that more signal lines will be required, and that connector line densities must be increased. Therefore, it is particularly desirable to provide a means for increasing the number of signal lines through a connector in such a way that both circuit cards having an improvement using more such lines and older circuit cards with fewer lines can be installed.

This type of compatibility is achieved by using the type of connector described in U.S. Pat. No. 4,934,961, to Piorunneck et al., which describes a bi-level card edge connector having two rows of contacts on each side of a central card-receiving slot. A new type of card configured for use with this connector has two rows of conductive pads on each side—a lower row adjacent to the card edge and an upper row adjacent to the lower row. The connector includes several keys extending across the central slot. When this new type of card is inserted into the slot, the keys align with keyway slots in the card, allowing the card to be fully inserted, so that, on each side, an upper row of connector contacts makes electrical connections with an upper row of conductive pads on the card, while a lower row of such contacts makes electrical connections with a lower row of conductive pads on the card. An older type of card, which has only a single row of conductive pads, adjacent to the edge, also lacks these keyway slots, so that such an older card can only be partially inserted, leaving the upper row of connector contacts providing electrical connections with the only row of card conductive pads on each side, while the lower row of connector contacts makes no electrical connections. Thus, the contact density of a card-edge connector is increased while means are provided to allow the use of both cards of the new type, having two rows of conductive pads per side, and of the old type, having only one row of conductive pads per side.

However, the connector and daughter card described in this patent, U.S. Pat. No. 4,934,961 to Piorunneck et al., does not have the advantage of compatibility in the other direction. Since an interconnection has been established wherein certain daughter cards have about twice as many connected circuits as others, and wherein both types of daughter cards can be used with the connector, the additional circuits must be non-essential, while essential circuits are connected through the only row of contact pads in a daughter card of the old type. Since these circuits are connected through the upper rows of connector contacts, these contacts must be the ones connected to essential circuits within the mother board, while non-essential circuits are wired through the lower rows of connector circuits and contact pads. If a card of the new type, having two rows of contact pads on each side, is plugged into a connector of the old type, only the non-essential circuits of the lower rows of pads will be connected with the essential circuits of the only row of contact springs. Thus, while the interconnection system proposed in this patent meets a need for being able to plug a card of an old type into a connector of a new type, it does not meet a need for being able to plug a card of a new type into a connector of an old type.

A number of connector designs are used to provide a "zero-insertion-force" feature, which allows the insertion of a daughter card into a connector without dragging the contact pads of the across the connector spring contacts. This feature can be achieved by stamping or forming the spring contacts so that they do not contact the daughter card in their free, undeflected state, i.e. by making the opening between opposing contacts wider than the width of the card. An actuator is provided to push inward on the spring contacts after the insertion of the card so that they are forced against the contact pads. Typically, a separate movement, to move the actuator, is required of the person assembling the daughter card into the connector.

An example of this kind of connector design is found in U.S. Pat. No. 4,080,027, which was issued to J. E. Benasutti on Mar. 21, 1988, which describes a connector wherein each contact terminal has a rigid conductive body with an attached flexible section in turn made up of an insulative portion and a conductive portion. After the insertion of a daughter card, a flexible actuator extending between the contacts and the sidewalls of the connector is slid axially within the connector to engage the contacts by pressing on their insulative portions, being itself compressed toward the center of the connector by the interactions between cam surfaces on the actuator and on the housing sidewalls.

Another example of this type of connector design is found in U.S. Pat. No. 4,904,197, which was issued to M. K. Cabourne on Feb. 27, 1990, which describes a connector in which multiple rows of contact springs are imbedded in a number of dielectric frame elements adjacently disposed along each side of a central card-receiving slot. A flexible stamped and formed spring extends axially under this slot. These frame elements are either held apart by a central portion of this spring when it is in an upper position, or they are pushed together by the outer portions of this spring when it is lowered. After the daughter card is inserted, a linear cam is pulled axially along the connector, lowering the spring so that pressure is exerted on the contact springs.

SUMMARY OF THE INVENTION

An electrical connector, configured for making removable connections with conductive surfaces on a daughter card assembly includes an insulative housing which defines the location of these conductive surfaces when the card assembly is engaged with the connector. The connector includes a first group of flexible contact terminals which in their free, undeflected state make contact with a fully inserted daughter card assembly, and a second group of flexible contact terminals which, in their free, undeflected state do not make contact with such a daughter card assembly. The connector also includes a slidable actuator which can move the second group of contact terminals into contact with a daughter card.

The actuator may include a surface moved by the card, so that the second group of terminals is automatically engaged with the card as it is engaged with the connector, and it may also include means to lock the card to the actuator as it is moved in this way, so that subsequent disengagement of the card with the connector returns the actuator to the position at which the second group of terminals is not engaged with an inserted card. Such locking means is also unlocked during the disengagement of the card with the connector, so that the card can be removed from the connector.

In an alternative embodiment, such automatic means for moving the actuator is replaced by the manual movement of the actuator through the use of a lever, which may, for example, axially slide a bracket on the connector housing. The bracket includes an inclined slot through which a tab from the actuator extends, so that the axial sliding motion of the bracket is transmitted into a motion of the actuator in a direction perpendicular to the connector axis.

This invention can be applied particularly to a card edge connector which is configured to removably receive either a daughter card of a first, presently-available type having a single row of contact pads on each side adjacent to the insertion edge of an insertion tab, or alternatively to removably receive a daughter card of a second type, having an extended contact pattern with two rows of contact pads on each side of the insertion tab. In this application, assuming that the daughter card extends upward from the connector, a lower row of contact springs on each side of a card-receiving slot always makes electrical contact with contact pads on a card, while an upper row of such springs on each side only makes contact with such pads when a daughter card of the second type is inserted in the connector.

In this application, when a daughter card of the second type is inserted in the connector, actuator moving surfaces contact adjacent surfaces of the actuator, moving it with the card as it is inserted. A daughter card of the first type includes slots adjacent to these actuator surfaces, so the actuator is not moved when such a card is inserted. A daughter card of the second type also includes apertures in which locking mechanisms operate to lock the card to the actuator as the insertion tab is inserted in the card-receiving slot. These locking mechanisms are moved into these apertures, and returned out of them, by inclined internal surfaces of the housing as the actuator is moved.

BRIEF DESCRIPTION OF THE DRAWINGS

For a fuller understanding of the nature and advantages of the invention, reference should be made to the following detailed description, taken in conjunction with the accompanying drawings, in which:

FIG. 5 is a partly exploded isometric view of a connector built in accordance with an alternative embodiment of the invention, showing a manually-operated mechanism for moving an actuator.

DESCRIPTION OF THE PREFERRED EMBODIMENTS

As described below, a connector is provided with a feature whereby the position of a sliding actuator determines whether certain contacts are pushed into engagement with adjacent surfaces of an inserted daughter card. Such a feature can be used, for example, in a connector configured to removably accept either presently-available daughter cards of a first type, having a single row of conductive contact pads on each side of an insertion tab, adjacent to an insertion edge, or a daughter card of a second type, having extended contacts, with two parallel rows of such pads on each side of the tab. Such a connector requires upper and lower rows of contacts on each side of a central insertion slot, with means to prevent electrical contact between the upper rows of contacts and adjacent surfaces of a presently-available, first-type daughter card, when such a card is inserted in the connector, due to the presence on at least some cards of this type of conductive surfaces in the regions which would otherwise be contacted by contacts in the upper rows. Contact with such conductive surfaces could result in cross connections, which would in turn result in equipment malfunction and even damage. A more thorough discussion of this application for an interconnect system having the ability to present variable contact patterns is found in a co-pending U.S. application, Ser. No. 858,803, filed Mar. 27, 1992, the disclosure of which is hereby incorporated by reference.

To simplify this discussion, the circuit card to which a connector is attached is called the "mother board," while the circuit card removably received in the connector is called the "daughter card." Furthermore, in discussing parts relative to directions, the assumption is made that the mother board is horizontal, while the connector and the daughter card extend upward from its surface. It is understood that the hardware will work equally well in other orientations.

Figure 1:
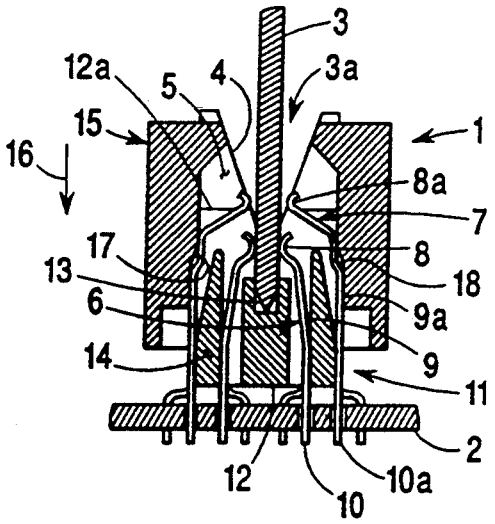
FIG. 1 is a transverse cross-sectional elevation of a connector with a sliding actuator in an upper position, taken through the contact structure area, including an inserted daughter card of a first type.

Referring to FIG. 1, a connector, generally designated 1, mounted to a mother board 2 removably accepts a first type of daughter card 3 in a card-receiving slot 3*a* defined by grooves 4 in a number of card guide tabs 5. Connector 1 includes, on each side of insertion slot 3*a*, a row of lower contact springs, generally designated 6, and a row of upper contact springs, generally designated 7. Each lower contact spring 6 includes an inward-formed contact section 8, a flexible central section 9, and a solder tail section 10. Each upper contact spring 7 includes an inward-formed contact section 8*a*, a flexible central section 9*a*, and a solder tail section 10*a*. These solder tail sections 10 and 10*a* extend through associated holes in mother board 2 to be attached by soldering to circuits within the mother board. Solder tail sections 10 and 10*a* may be arranged, for example, in staggered alignment as described in co-pending U.S. application Ser. No. 858,803, filed Mar. 27, 1992, the disclosure of which has been incorporated herein by reference.

Figure 1A:
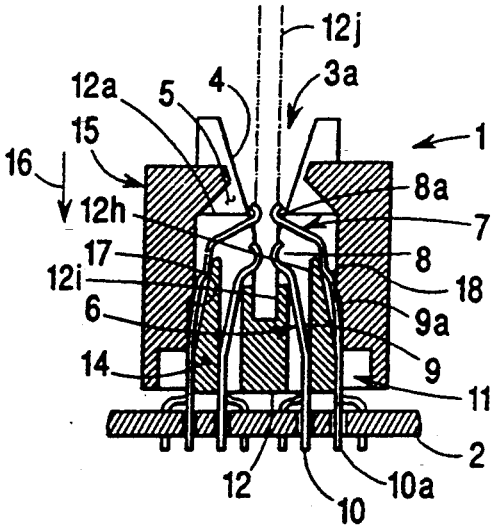
FIG. 1*a* is a cross-sectional elevation of the connector of FIG. 1, with the sliding actuator in a lower position, taken through the contact structure area, without an inserted daughter card.
Figure 2:
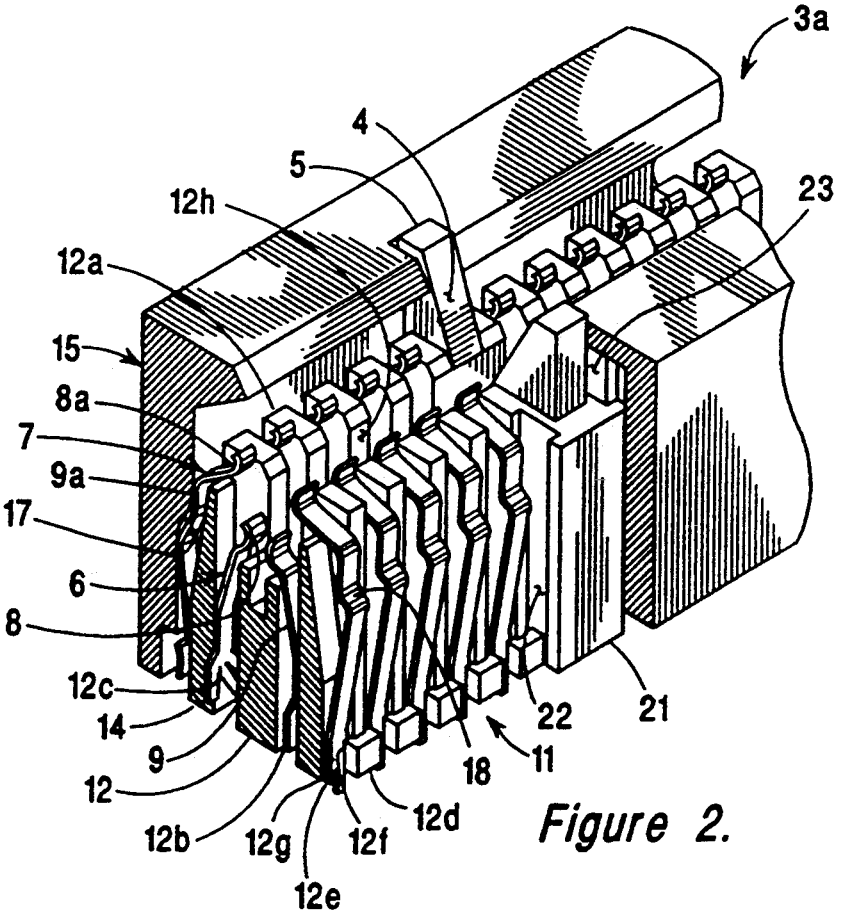
FIG. 2 is a partial isometric view of the connector of FIG. 1, from above and to the side.

Referring to FIGS. 1, 1*a*, and 2, connector 1 includes an insulative housing structure, generally designated 11, which in turn includes an axially slotted support structure 12 to accept and align a beveled insertion edge 13 of daughter card 3, and a number of partitioning sections 12*a* extending between axially adjacent contact springs 6 and 7. Each lower contact spring 6 includes a pair of tab portions 12*b* extending laterally into slot (not shown) within adjacent partitioning sections 12*b*, establishing a clamping section 12*c* at which the contact is held in place within housing structure 11. Partitioning sections 12*a* further include outward-extending clamping structures 12*d*. Similarly, each upper contact spring 7 includes a pair of tab portions 12*e* extending laterally into slots 12*f* within adjacent clamping structures 12*d*, establishing a clamping section 12*g* at which the contact is held in place within housing structure 11.

Inward-directed vertical surfaces 12*h* of partitioning sections 12*a*, together with inward-directed surfaces 12*i* of slotted support structure 12, establish a central slot in which a daughter card 3 is received (as shown in FIG. 1), thereby establishing, at each side of the center of connector 1, an engagement plane 12*j* (shown in FIG. 1*a*) to establish the location of a surface of an inserted daughter card. Connector 1 also includes outer contact support structures 14 and an insulative sliding actuator, generally designated 15, which is mounted to move on housing structure 11, from the upper position in which it is shown in FIGS. 1 and 2, to a lower position, as shown in FIG. 1*a*.

Each lower contact spring 6 is formed so that its contact section 8 is held against the adjacent surface of daughter card 3. On the other hand, each upper contact spring 7 is formed so that, with this spring in its free, undeflected state, a gap remains between inward-formed contact section 8*a* and the adjacent surface of a daughter card inserted in slot 3*a*. This free state is retained whenever sliding actuator 15 is in its upper position, as shown in FIG. 1. However, as sliding actuator 15 is moved downward, in the direction of arrow 16 into a lower position, as shown in FIG. 1*a*, the inclined sections 17 on the inner surfaces of this actuator contact inclined sections 18 in flexible central sections 9*a* of upper contact springs 7, moving these central sections 9*a* inward so that contact sections 8*a* bear against the adjacent surfaces of a daughter card inserted in slot 3*a*. If no daughter card is present in the connector when sliding actuator 15 is moved downward, as shown in FIG. 1*a*, contact sections 8*a* are moved into card receiving slot 3*a*.

Housing structure 11 includes a number of integral slide structures 21, as shown in FIG. 2, having grooved surfaces 22, which form tracks where bars 23, which are integral portions of sliding actuator 15, slide during the motion of this actuator between its upper and lower positions. These slide structures 21, which form tongue-in-groove assemblies with bars 23 of actuator 15, are configured in pairs on opposite sides of housing structure 11 and are joined by guide tabs 5, of housing structure 11, the lower portions of which extend across the connector, so that outward deflection of sliding actuator 15 is resisted by applying tensile stresses to the housing structure.

Thus, sliding actuator 15 is mounted so that it can be moved between an upper and a lower position. When actuator 15 is in its upper position, only lower contact springs 6 make electrical contact with the surfaces of an daughter card inserted in slot 3*a*. When sliding actuator 15 is in its lower position, both lower contact springs 6 and upper contact springs 7 are held against the surfaces of a daughter card in slot 3*a*.

Figure 3:
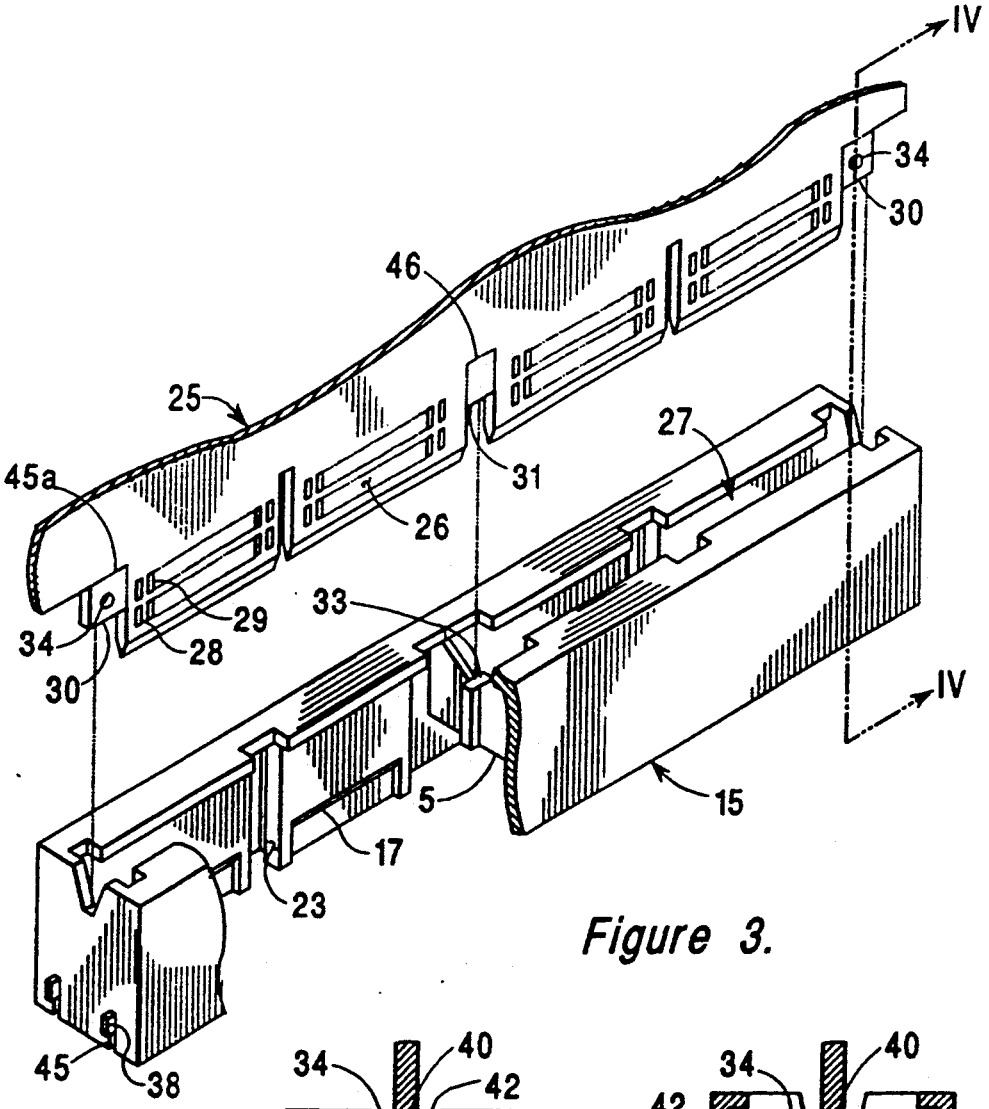
FIG. 3 is a isometric view of a sliding actuator of the connector shown in FIG. 1, together with the insertion tab portion of a daughter card of a second type, having an extended contact pattern, with the actuator partially cut away to show internal structure.

In order to maintain the proper patterns of contact engagement, sliding actuator 15 remains in its upper position when no card is inserted in slot 3*a*, and when a first type of daughter card 3 is installed therein. If a daughter card of a second type, having an expanded contact pattern, is inserted in slot 3*a*, electrical contact with all of the contacts 7 and 9 is required for full functions, so the sliding actuator 15 is moved downward in a manner that will now be explained with reference to FIG. 3, which shows a daughter card of this second type, generally designated 25, having an expanded contact pattern, above sliding actuator 15. This daughter card 25 includes a slotted insertion tab 26, which is removably inserted into slot 27 of sliding actuator 15. Insertion tab 26 includes, on each side, a lower row of contact pads 28 and an upper row of contact pads 29, on each end, an end actuation edge 30, and, at the center, a central actuation edge 31. When insertion tab 26 is partly inserted into slot 27, actuation edges 30 and 31 contact end actuation surfaces 32 and central actuation surface 33, respectively, of sliding actuator 15, so that further insertion motion moves this actuator 15 downward, with the daughter card 25, from its upper position into its lower position.

Figure 4:
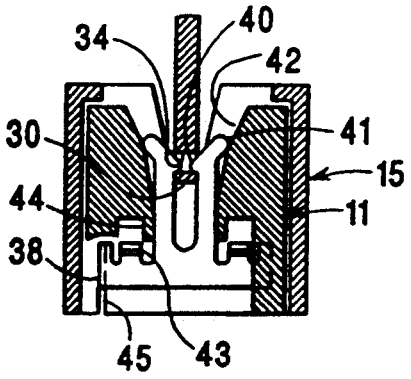
FIG. 4 is a transverse cross-sectional view of the connector shown in FIG. 1, with an inserted daughters card of the second type, having an extended contact pattern and with the sliding actuator in the lower position, shown in the direction of section line IV—IV in FIG. 3 to depict a latching mechanism used to restore the sliding actuator as the daughter card is removed.
Figure 4A:
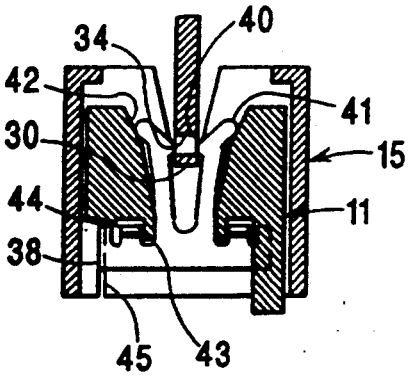
FIG. 4*a* is a transverse cross sectional view of the connector of FIG. 1, taken as FIG. 4 with the sliding actuator in the upper position.

As shown in FIGS. 4 and 4*a*, means are also provided to assure that when a daughter card 25, of this second type having an extended contact pattern, is withdrawn upward, actuator 15 is moved back into its upper position. In this way, if this card is replaced by a first type of daughter card 3, upper-row contacts 7 will be left out of engagement. This capability is achieved by locking actuator 15 to daughter card 25 during a portion of the upward motion withdrawing the card from the connector. A locking aperture 34 is provided at each end of insertion tab 26 above an actuation edge 30. Referring to FIG. 4, a locking clip, generally designated 37, is fastened to an interior surface of each end of sliding actuator 15 by means of tabs 38, so that this locking clip 37 moves in either direction between a lower position, as shown in FIG. 4, and an upper position, as shown in FIG. 4*a*, with similar movement of actuator 15. This locking clip 37 includes a pair of flexible arms 39, each of which terminates in an inward-extending tip 40, positioned to move into a locking aperture 34 of daughter card 25, and in an outward-extending tip 41, which slides along an adjacent internal inclined surface 42 of housing structure 11. Locking clip 37 is configured so that, in its free state, outward-extending tips 41 extend outward beyond the limits provided by inclined surfaces 42; i.e. during the motion of locking clip 37, tips 41 are held against surfaces 42 by stresses within the clip. Inclined surfaces 42 are angled so that, when sliding actuator 15 and locking clip 37 are in their lower position, daughter card 25 is held locked to actuator 15, and so that, when sliding actuator 15 and locking clip 37 are in their upper position, daughter card 25 is released for removal from connector 1. Locking clip 37 also includes a pair of limit stop tabs 43, sliding in limit stop slots 44 of housing structure 11, which limit the upward travel of the locking clip and of sliding actuator 15, thereby defining their upper positions and preventing the removal of these parts from connector 1.

Tabs 38 of locking clip 37 are also used in the final step of the process of assembling connector 1. These tabs are moved upward, fitting tightly in slots 45 after actuator 15 is brought downward on housing structure 11.

In summary, during the insertion of daughter card 25, as this card and sliding actuator 15 move downward together, from the upper position of FIG. 4*a* to the lower position of FIG. 4, with actuation edges 30 and 31 of card 25 pushing actuation surfaces 32 and 33, respectively, of actuator 15, flexible arms 39 are moved inward by internal inclined surfaces 42, so that inward-extending tips 40 of locking clips 37 are moved into holes 34 of card 25. If the daughter card is subsequently removed, sliding actuator 15 is pulled back upward, into its upper position, by inward-extending tips 40, which are held in apertures 34 by inclined surfaces 42. As the upward motion of sliding actuator 15 is completed, the outward motion of tips 41 in contact with surfaces 42 allows the release of the daughter card. After this, the forces of upper-row contact springs, as shown in FIG. 1, on internal surfaces of sliding actuator 15 hold this actuator in its upper position.

The dimensional relationships among daughter card 25, sliding actuator 15, and upper-row contact springs 7 can be established so that contact sections 8*a* of these springs make contact with contact pads 29 through a relatively short distance before the daughter card is fully inserted. Such sliding contact, which helps clean the contact surfaces as the daughter card is inserted, is a primary advantage of the conventional sliding contact.

Referring again to FIG. 3, a daughter card of the first type, i.e. one with a single row of contact pads on each side, has an insertion tab with an outline shown by phantom lines 45*a* and 46. Thus, actuation edges 30 and 31 are not present, so actuator 15 is not pressed downward when such a card is inserted.

In place of the mechanism described above for locking the motion of sliding actuator 15 to that of a daughter card 25, a spring or series of springs pressing upward on actuator 15, can be used to assure that this actuator is returned upward when a daughter card 25 is removed from connector 1, with actuation surfaces 32 and 33 of the actuator in contact with actuation edges 30 and 31 of the daughter card. Such a spring or series of springs would have to provide sufficient force to overcome friction forces within the connector.

An alternate embodiment of this invention, which is shown in FIG. 5, provides a contact pattern which is variable manually, instead of a pattern which is varied automatically when the card is inserted. In this embodiment, a connector, generally designated 49, includes an insulative housing, generally designated 50, and a sliding actuator, generally designated 51, which together define a central card-receiving slot 52. Housing 50 includes a first plurality of flexible contact springs of a first type (not shown), with contact sections which extend flexibly into slot 52 and a second plurality of contact springs of a second type (not shown), with contact sections which extend adjacent to slot 52, but which are displaced from this slot. For example, these contact springs of a first type may be shaped as lower-row contact springs 9, while these contact springs of a second type may be shaped as upper-row contact springs 7, both of which have been discussed in reference to FIGS. 1 and 2. Sliding actuator 51 includes internal surfaces which move the contact springs of the second type into the card-receiving slot 52. For example, it may include internal inclined surfaces like inclined surfaces 17, which have also been described in reference of FIGS. 1 and 2. Actuator 51 is mounted to slide on insulative housing 50 between an upper position, in which contact springs of the second type are not engaged with slot 52, and a lower position, in which these springs are moved for engagement within this slot.

This connector 49 also includes a sliding framework for moving sliding actuator 51, which consists of a pair of slotted brackets, generally designated 53, fastened together by screws 54 and 55 through clearance holes 56 and threaded holes 57. This framework is moved axially by lever 58, which is pivotably mounted on hole 59 in connector housing 50 by screw 60, and which is attached to brackets 53 by the sliding of shoulder portion 61 of screw 54 in slot 62. Connector housing 50 also includes, on each side, a slot 63, in which a flange 64 extending inward from bracket 53 slides axially, thereby limiting these brackets to axial motion. Sliding actuator 51 includes, on each side, a pair of outward-extending inclined tabs 65, which slide in inclined slots 66 in brackets 53. The angle of these inclined slots 66 transfers axial motion of brackets 53 into simultaneous vertical motion of actuator 51. Thus, when lever 58 is pivoted in the direction of arrow 67, the resulting axial motion of brackets 53 moves actuator 51 downward, between an upper position in which spring contacts of the second type (not shown) are not held in contact with an inserted daughter card into a position in which such springs are held in contact with such a card. This action can be reversed by pivoting lever 58 in the direction opposite to arrow 67.

While the applicability of this invention has been discussed particularly with regard to the use of daughter cards of presently-available types on connectors having extended contact patterns, it is understood that this invention can be used to advantage in other applications where it is desirable to provide a selective pattern of electrical connections. Although the invention has further been described in preferred forms or embodiments with some degree of particularity, it is understood that this disclosure has been made only by way of example, and that numerous changes in the details of construction, fabrication and use may be made without departing from the spirit and scope of the invention.

What is claimed is:

1. An electrical connector for removably receiving an insertion tab of a daughter card, said connector comprising:

an insulative connector housing including a central card-receiving slot, open at one surface to receive said insertion tab in an insertion direction;

a first plurality of contact terminals of a first type, each of said first contact terminals of said first type including a solder tail section extending outside said housing, a clamping section held by said housing, a centrally-facing contact section extending into said card-receiving slot to engage said insertion tab when said insertion tab is within said card-receiving slot, and a flexible section extending between said clamping section and said contact section;

a second plurality of contact terminals of a second type, each of said second contact terminals of said second type including a solder tail section extending outside said housing, a clamping section held by said housing, a centrally-facing contact section extending adjacent to said card-receiving slot but displaced therefrom when each of said second contact terminals of said second type is in a free, undeflected state, a flexible section between said clamping section and said contact section, and an outwardly-facing actuation section;

an actuator extending around a portion of said housing, around said second contact terminals of said second type, and around an upper central slot, said actuator including internal surfaces centrally inclined and engageable with a plurality of said actuation sections of said second contact terminals of said second type, said actuator being slidably mounted on said housing to move in said direction of insertion between a first position, in which a plurality of contact sections of said second type are displaced from said card-receiving slot, and a second position, in which said contact terminals of said second type are deflected to place said contact sections thereof within said card-receiving slot, said actuator being additionally returnable between said second position and said first portion;

a bracket mounted on said housing to slide in an axial direction, said bracket including a ramp surface inclined relative to said axial direction; and a driving surface extending from said actuator in contact with said ramp surface.

2. An electrical connector as recited in claim 1, comprising in addition a lever pivotably mounted on said housing and connected to said bracket, wherein motion of said lever moves to said bracket.

3. An electrical connector as recited in claim 1:

wherein said first contact terminals of said first type comprise a first row of contact terminals on each side of said central card-receiving slot;

wherein said second contact terminals of said second type comprise a second row of contact terminals on each side of said central card-receiving slot;

wherein said contact section of each of said first contact terminals of said first type is disposed a first distance from said one surface of said housing; and wherein said contact section of each of said second contact terminals of said second type is disposed a second distance from said one surface of said housing, said second distance being substantially less than said first distance.

* * * * *